US006698755B2

(12) United States Patent
Cherry

(10) Patent No.: US 6,698,755 B2
(45) Date of Patent: Mar. 2, 2004

(54) TWO LEVEL GAME

(75) Inventor: David J. Cherry, Florence, KY (US)

(73) Assignee: Arrow International, Inc., Cleveland, OH (US)

( * ) Notice: Subject to any disclaimer, the term of this patent is extended or adjusted under 35 U.S.C. 154(b) by 0 days.

(21) Appl. No.: 10/292,647

(22) Filed: Nov. 12, 2002

(65) Prior Publication Data

US 2003/0116916 A1 Jun. 26, 2003

Related U.S. Application Data

(60) Provisional application No. 60/333,218, filed on Nov. 14, 2001.

(51) Int. Cl.[7] ..... A63F 3/06
(52) U.S. Cl. ..... 273/139; 273/292; 273/138.1
(58) Field of Search ..... 273/292, 139

(56) References Cited

U.S. PATENT DOCUMENTS 4,943,090 A * 7/1990 Fienberg ..... 273/139
5,046,737 A * 9/1991 Fienberg ..... 273/139
5,158,293 A * 10/1992 Mullins ..... 273/139
5,407,200 A * 4/1995 Zalabak ..... 273/139
5,671,921 A * 9/1997 Quinlan ..... 273/139
5,743,524 A * 4/1998 Nannicola ..... 273/139
5,921,547 A * 7/1999 Wilner ..... 273/139
5,931,468 A * 8/1999 Orolin ..... 273/139
5,934,671 A * 8/1999 Harrison ..... 273/139
6,305,687 B1 * 10/2001 Pollock et al. ..... 273/269
6,390,916 B1 * 5/2002 Brown ..... 463/17
6,612,576 B1 * 9/2003 Stancik et al. ..... 273/139

* cited by examiner

*Primary Examiner*—Benjamin H. Layno
*Assistant Examiner*—Dolores R. Collins
(74) *Attorney, Agent, or Firm*—Fay, Sharpe, Fagan, Minnich & McKee, LLP

(57) ABSTRACT

A "lottery-type" game of chance for a plurality of players employs break open playing cards (10), at least some of the playing cards having printed on them one or more immediate instant win a award indicator wards (44). Some of the playing cards (10) have printed on them a bonus ticket symbol (42) that entitles the holder to receive a set (50) of bonus tickets (12). Some of the bonus tickets (12) have printed on them one or more instant win awards (78). The awards on the cards and tickets (10, 12) are covered, prior to play, with one or more removable cover members (34, 100) such as flaps or scratch off seals. Some of the playing cards (10) include one or more eligible game symbols (82), which entitle the playing card holder to enter a bonus round of play. The holder of a playing card (10) thus has three (or more) potential ways to become a winner.

19 Claims, 7 Drawing Sheets

TWO LEVEL GAME

This application claims the priority of U.S. Provisional Application Serial No. 60/333,218, filed Nov. 14, 2001.

BACKGROUND OF THE INVENTION

The present invention relates to gaming systems and, more particularly, to a lottery-type gaming system.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

One type of game system which has proven quite popular with players is the so-called break-open ticket game. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially sealed, and are revealed by "breaking open" one or more flap-like portions of the upper ply.

As will be appreciated, affording players an opportunity to win awards in different ways enhances the entertainment value of the game. It has, therefore, been considered desirable to develop a new and improved seal card game and method for playing same which would meet the above stated needs and others and provide advantageous overall results.

SUMMARY OF THE INVENTION

Briefly, one aspect of the present invention relates to a system for use in playing a game of chance. The system includes a plurality of playing cards, each of the playing cards including one or more game symbols displayed thereon. Several of the playing cards may display instant win symbols which entitle the holder to collect an associated award. Several of the playing cards may display potentially winning symbols, which entitle the holder to enter a bonus level of play. Several of the playing cards display bonus ticket symbols, which entitle the holder to receive one, or more preferably, a set of bonus tickets. Several of the bonus tickets may display instant win symbols which entitle the holder to collect an associated award. A master game card is provided for use in conjunction with the plurality of playing cards and bonus tickets.

In accordance with one embodiment of the present invention, a system for use in playing a game of chance is provided. The system includes a plurality of playing cards. Each of the playing cards includes at least one game symbol displayed thereon. Some of the playing cards display a bonus ticket symbol which entitles a holder of the playing card to receive at least one bonus ticket. The system further includes a plurality of the bonus tickets. Each bonus ticket displays a game symbol. At least one of the bonus tickets includes a winning one of the bonus ticket symbols which associated with a bonus ticket award.

In accordance with another aspect of the invention, a system for use in playing a game of chance includes a plurality of playing cards. Each of the playing cards includes at least one of a plurality of game symbols displayed thereon. Some of the playing cards display one of the game symbols which is bonus ticket game symbol. Each bonus ticket game symbol entitles a holder of the ticket to receive a plurality of bonus tickets. Some of the playing cards displaying one of the game symbols which is an eligible game symbol, eligible for a bonus round award. The system further includes a plurality of the bonus tickets. At least one of the bonus tickets includes an indicia for identifying the bonus ticket as a winning bonus ticket. A master game card is provided for use in conjunction with the playing cards. The master game card includes means for identifying one of the eligible game symbols as a winning game symbol.

In accordance with another aspect of the present invention, a method of playing a game of chance is provided. The method includes distributing a set of playing cards to a plurality of players. At least one cover member on each of the playing cards is removed to reveal at least one of a plurality of game symbols. Some of the playing cards include an eligible one of the game symbols which is eligible for a bonus round of play. Some of the playing cards include one of the game symbols which is a bonus ticket game symbol. This entitles a holder of the playing card displaying the eligible game symbol to receive at least one bonus ticket from a plurality of bonus tickets. A cover member is removed from at least one of the bonus tickets. At least one of the bonus tickets includes an identifier for identifying an instant win award. In the bonus round of play, a winning game symbol selected from said eligible game symbols associated with a bonus award is revealed. A holder of the playing card displaying the winning game symbol receives the bonus award.

In accordance with another aspect of the present invention, a method of playing a game of chance is provided. The method includes distributing a set of playing cards to a plurality of players. The playing cards are configured for selectively revealing a plurality of game symbols. At least a first of the game symbols is employed in a first level of play and at least a second of the game symbols is employed in a second level of play. At least some of the plurality of game symbols are revealed. In a first level of play, at least one bonus ticket of a plurality of bonus tickets is awarded to at least one of the players holding one of the playing cards which displays the first game symbol. Some of the bonus tickets include an identifier for identifying an instant win award.

In a second level of play, a bonus award is awarded to at least one of the players holding a card which displays the second game symbol.

The advantages of the present invention will become apparent to those skilled in the art upon a reading and understanding of the following detailed specification.

BRIEF DESCRIPTION OF THE DRAWINGS

The invention may take physical form in certain parts and arrangement of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
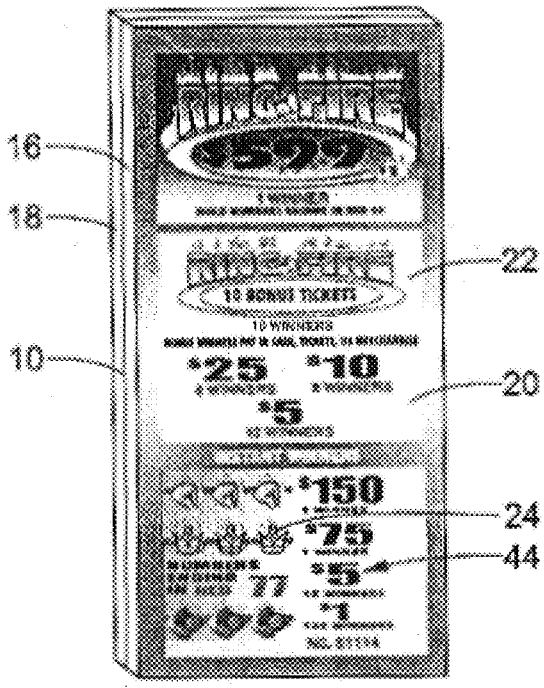
FIG. 1 is a top perspective view of a front face of a playing card for a multiple level game system according to the present invention.
Figure 2:
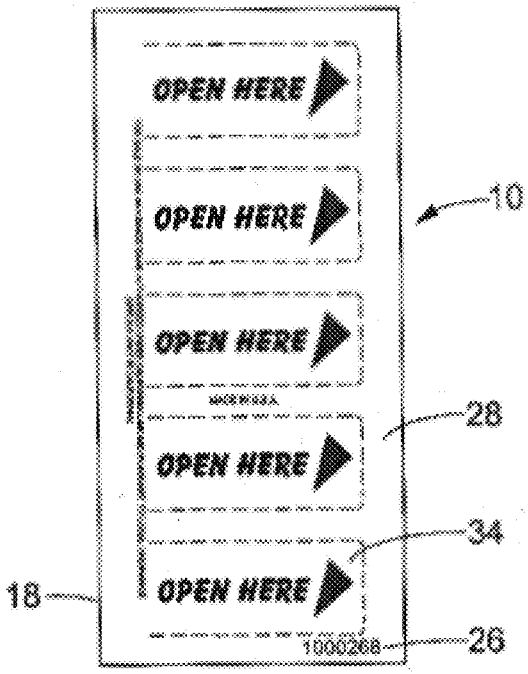
FIG. 2 is a top plan view of a rear face of the playing card of FIG. 1.

While this invention is susceptible of embodiment in many different forms, there is shown in the drawings and will herein be described in detail, several preferred embodiments of the invention. However, it should be understood that the Figures are to be considered only as exemplifying the principles of the invention and are not intended to limit the invention to the embodiments illustrated.

Figure 4:
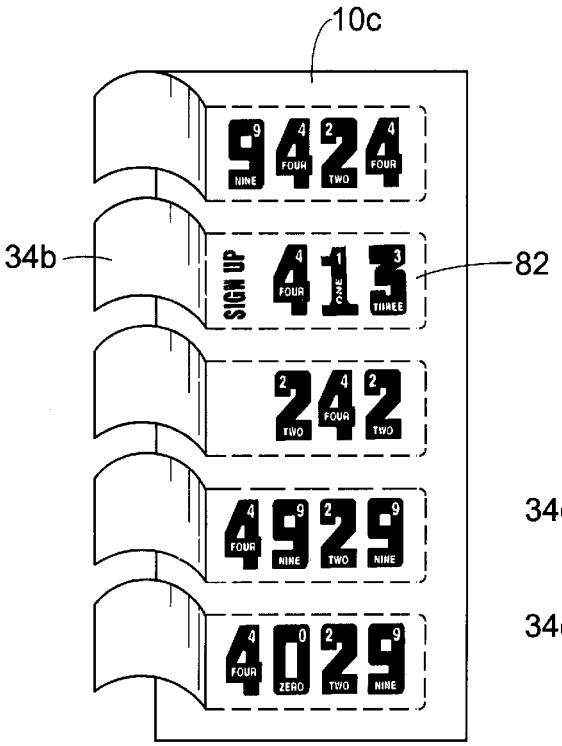
FIG. 4 is a perspective view of the rear face of a second playing card.
Figure 5:
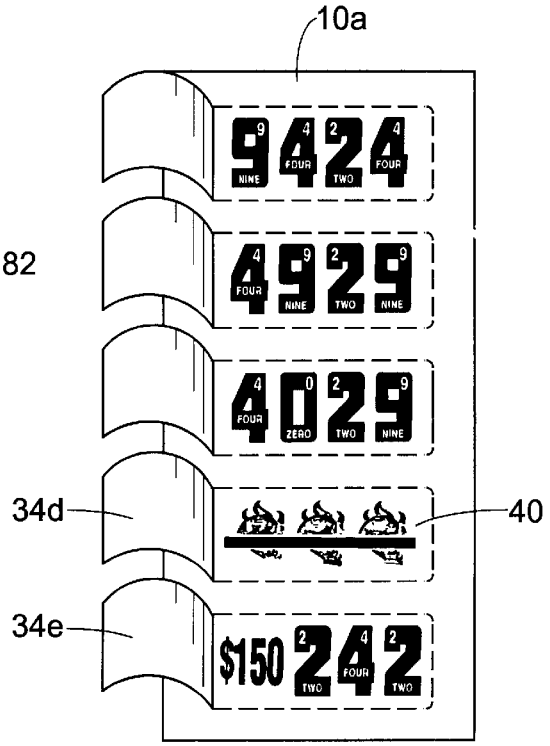
FIG. 5 is a perspective view of the rear face of a third playing card.
Figure 6:
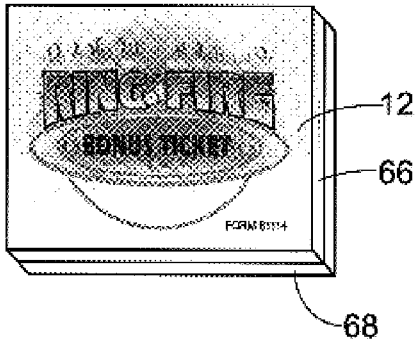
FIG. 6 is a perspective view of a front face of a bonus ticket according to the present invention.
Figure 7:
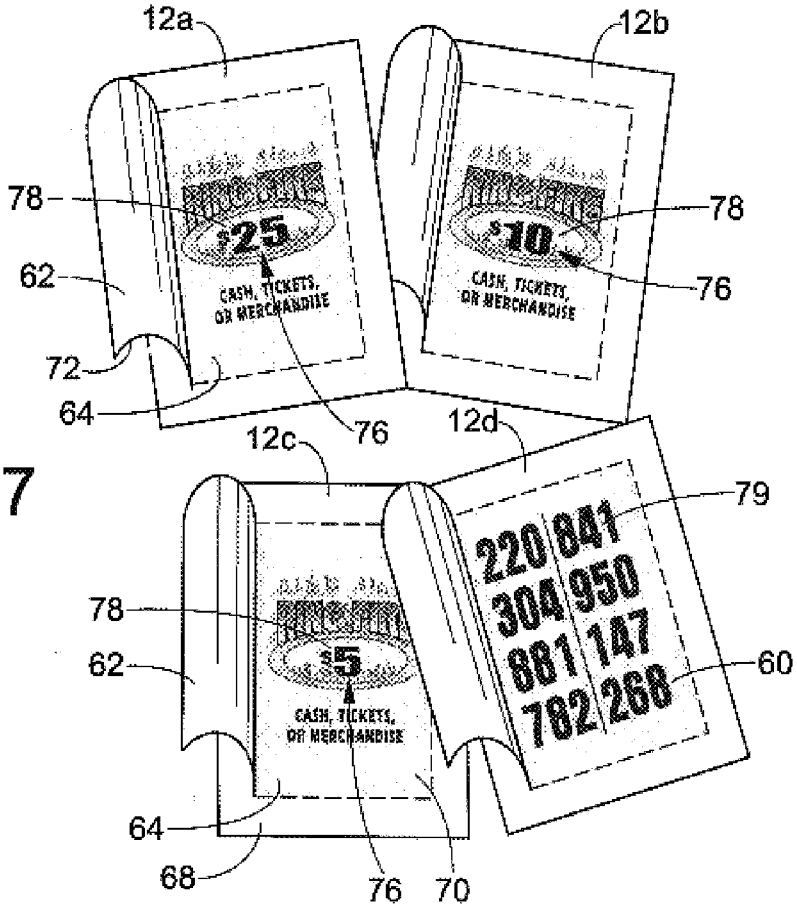
FIG. 7 is a perspective view of the rear faces of four of the bonus tickets of FIG. 6 with the flaps open.
Figure 8:
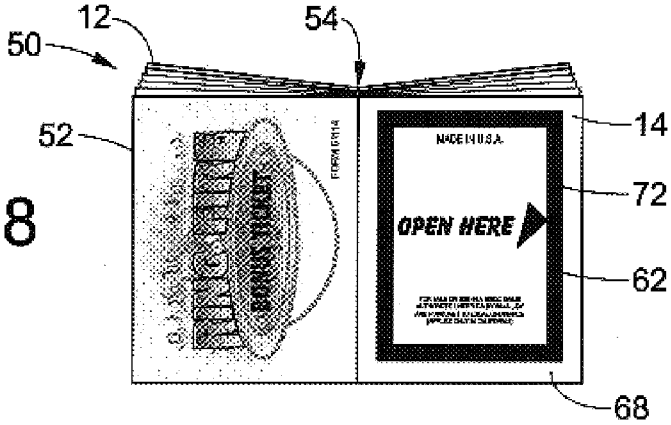
FIG. 8 is a perspective view of a book of the bonus tickets of FIGS. 6 and 7.
Figure 9:
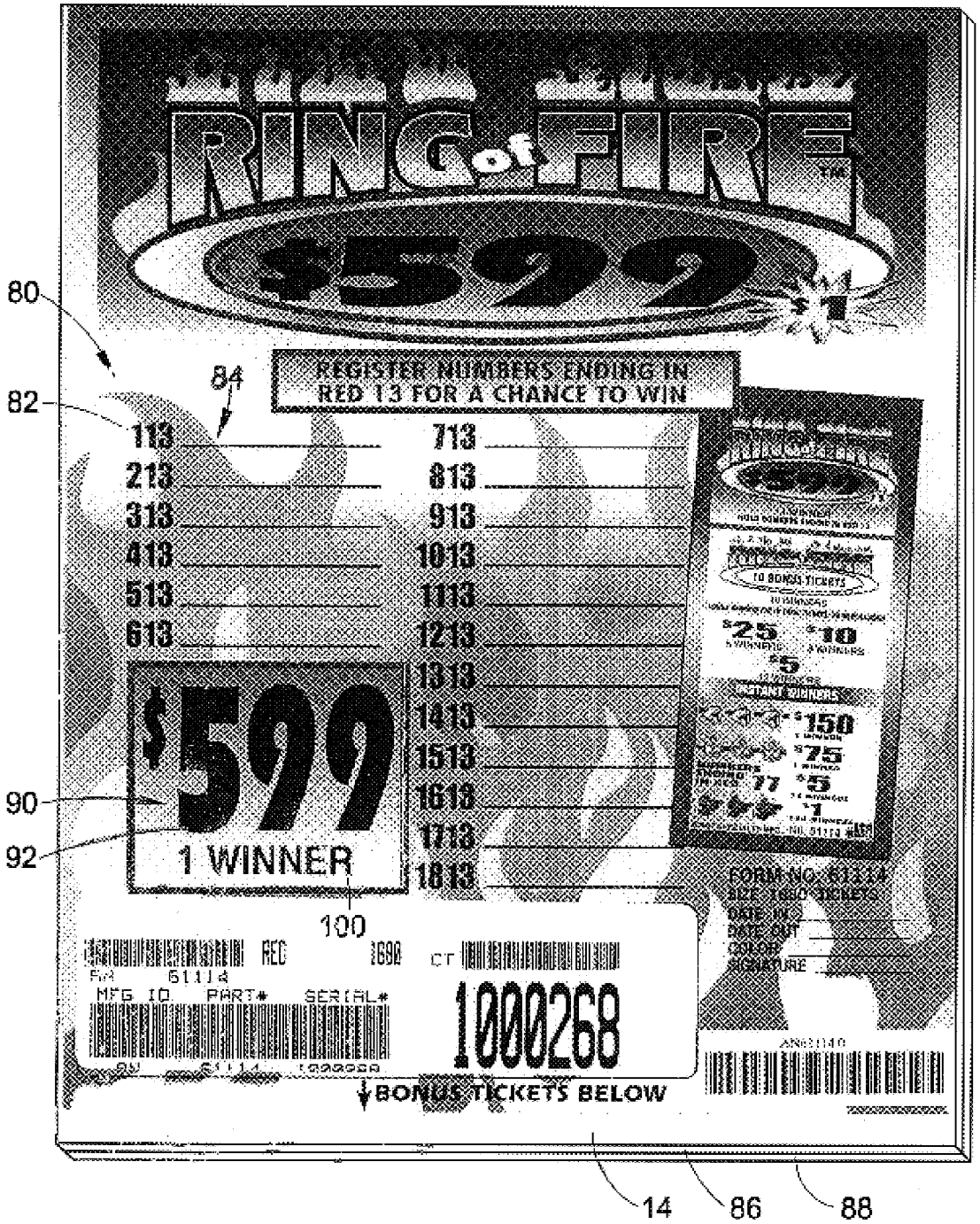
FIG. 9 is a top perspective view of a master game card of the game system according to the present invention.
Figure 10:
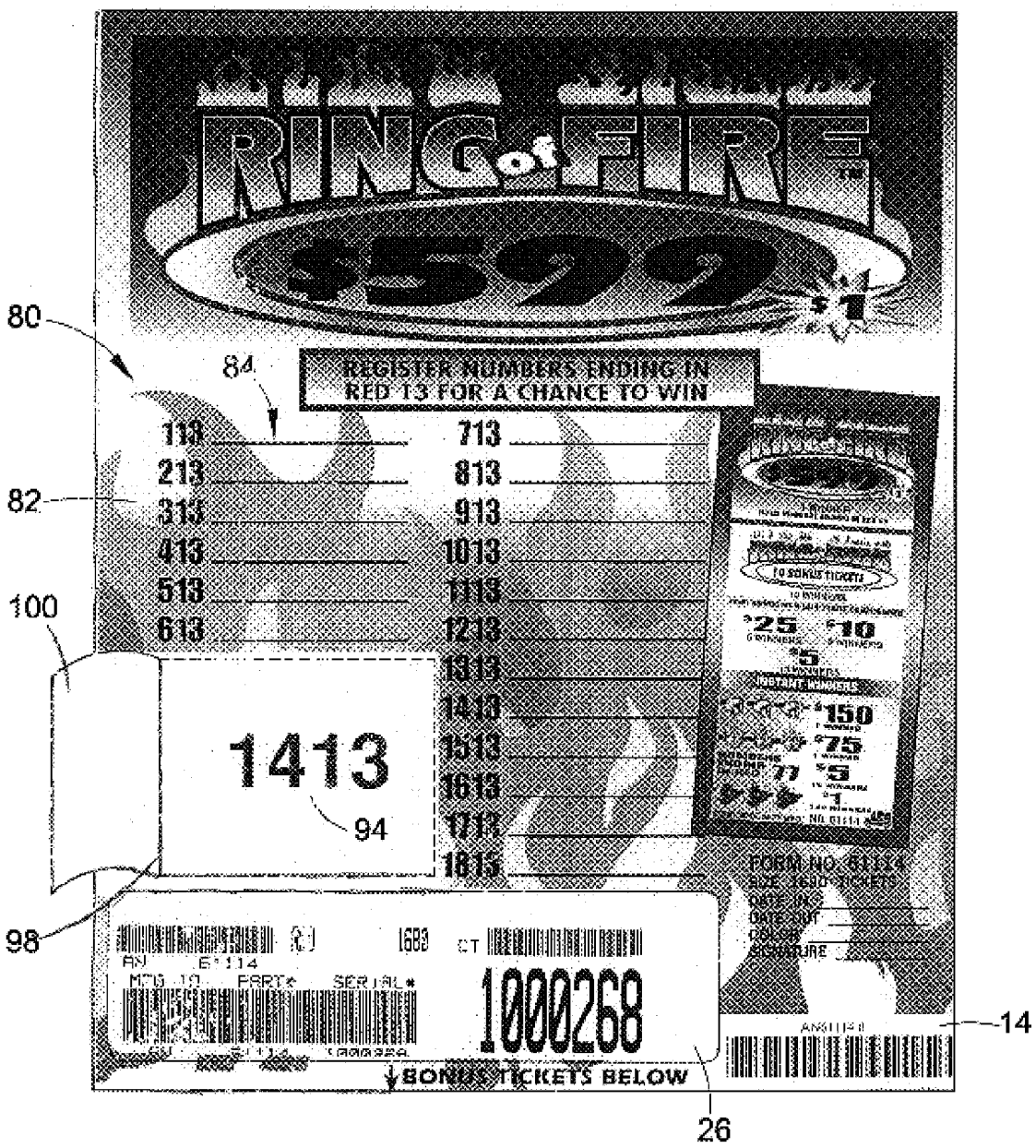
FIG. 10 is a top perspective view of the master game card of FIG. 9 with the flap open to reveal the winning symbols.

FIGS. 1–5 illustrate playing cards or tickets 10, FIGS. 6–8 illustrate bonus tickets 12, and FIGS. 9 and 10 illustrate a master game card 14. The playing cards 10, bonus tickets 12, and master game card 14 are used in combination for playing a game of chance, namely a two level game system according to the present invention. Certain ones of the players are eligible to participate in the selection of a bonus award on the master game card 14. While the game is described with reference to a first "instant win" level of play followed by a single bonus round of play, it will be appreciated that the instant win level may be modified and additional bonus rounds may be used, for example, two, three, four, or more bonus levels of play.

Playing card 10 is intended as exemplary, in that the present game system includes a substantial number of such playing cards. In a preferred embodiment, for example, about 300 to about 2,000 cards are employed. Each of the playing cards 10 is purchased by a game player for a nominal sum, such as $1. The playing card price is preferably printed on the card 10, although it is also contemplated that a game organizer may be free to set the playing card price and thus determine the total profit accordingly.

The playing cards 10 and bonus tickets 12 are preferably packaged as a set or deal, in a clear wrapping (not shown), together with the master game card 14. By having a fixed number of cards 10 and tickets 12 in the set of playing cards and bonus tickets, the total payout and the profit to the organizer can be predetermined (assuming all playing cards 10 in the set are sold and all bonus tickets 12 are redeemed for awards). Additionally, the sets of bonus tickets 12 and playing cards 10 are assembled such that the total payout is the same for each deal.

As shown in FIG. 1, each of the playing cards 10 preferably comprises upper and lower layers or plies 16 and 18 of material, laminated together at the edges of their inner surfaces, and formed from paper, card, or the like. An outer, first face 20 of one of the plies 16 may be used to display information about the game, such as the rules of the game 22, examples of winning combinations 24 of "instant win" symbols, information about the bonus tickets, and the like (see FIG. 1). The price of each playing card ($1.00 in the illustrated embodiment) is also printed on the first face 20 or elsewhere on the playing card 10. Alternatively, the first face may be left blank. An identifying character 26, such as a serial number, is optionally printed on the front face 20 or a rear face 28 of the card 10 for identifying the playing card 10 as being part of the set of playing cards, all with the same serial number and associated with a corresponding serial number printed on the master game card 14. This avoids the instance of a player from a previous game trying to collect an award in a subsequent game using the same card 10 or ticket 12.

Figure 3:
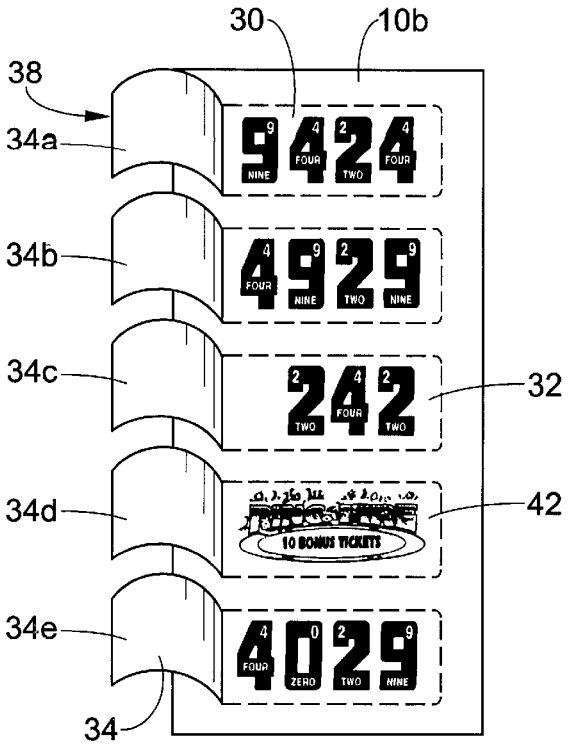
FIG. 3 is a perspective view of the rear face of the playing card of FIG. 2 with five flaps opened.

With particular reference to FIG. 3, each of the playing cards 10 displays at least one, more preferably, a plurality of game symbols 30. The symbols 30 may be letters, numbers, and/or characters, such as fruit, diamonds, dollar signs, crowns, bells, and the like commonly associated with lottery games, which may be arranged singly, or in groups. Each of the cards 10 includes a plurality of cover members, a single cover member, or other game symbol concealing means, such as a scratch-off layer. Preferably, the symbols 30 are displayed on an inside surface 32 of the upper ply 16 of the card. This type of card 10 is typically referred to as a "break-open" playing card, in that the cover member comprises one or more flap-like portions 34 of the lower ply 18 (five flaps 34 for each card 10 are shown in FIGS. 2–5) which each cover one or more game symbols 30. The flaps 34 can be selectively opened (e.g., peeled away from the card 10) in order to reveal windows 36 displaying the respective one or group of game symbols 30 beneath, after the card has been purchased. The flaps 34 have perforated edges 38, allowing them to be readily separated from the surrounding upper ply material.

In its first, "instant win" level of play, the game preferably has two types of instant win game symbols, "immediate win" symbols 40 and "bonus ticket" symbols 42. The immediate win symbols 40 are those symbols which identify an immediate instant winner. To assist players in ascertaining winning cards at the first level of play, a listing 24 of the winning groups of immediate win award symbols is provided on the front face of each playing card and/or the master game card. The present game system provides awards 44 to those players having cards which display a predetermined immediate win winning symbol or combination of award symbols 40.

In the embodiment shown in FIG. 1, by way of example, a winning group of award symbols 40 comprising three diamonds wins a $150 award 44 instantly; three crowns wins $75; while a group of numbers ending in red 77 wins $5, and so forth. The playing card holder compares the symbol or groups of symbols under each flap 34 with the different groups of immediate win award symbols on the listing 24 to determine whether the playing card is an immediate-winning playing card. FIG. 5 exemplifies an immediate win card 10*a* having a group of three diamonds under one of the flaps 34*d*. Optionally, the adjacent flap 34*d* reveals the amount of $150, which is the value of the award associated with the three diamonds symbol 40. An immediate-win game player takes the winning playing card 10*a* to a game organizer and receives the winning amount accorded to the particular winning symbol or group of symbols 40 (FIG. 1).

In another embodiment, the immediate win symbols are not used. In this embodiment, all instant win prizes are awarded through the bonus ticket symbols 42.

The second type of instant win symbol 30 is the bonus ticket symbol 42. This symbol is not associated with a particular award, but gives the holder of the playing card the chance to win an award. Preferably, for convenience of the game organizer, a single playing card displays no more than one instant win symbol 40, 42, although multiple instant win game symbols may, alternatively, be provided on a single card. FIG. 3 exemplifies a playing card 10*b* showing an award indicator or bonus ticket symbol 42 revealed by one of its flaps 34*d*.

A player who uncovers a bonus ticket symbol 42 takes the card 10*b* to the game organizer and receives one or more bonus tickets 12 (FIGS. 6–7). Preferably, the player receives a set 50 of bonus tickets 12 (FIG. 8). For convenience, the set of bonus tickets may be packaged in a clear wrapping. Alternatively, the organizer may have a stack of, for example, one-hundred bonus tickets, and hand out ten of these to each holder of a bonus ticket symbol 42. FIG. 8 by way of example, shows a set 50 of ten of these tickets 12 arranged in a booklet 52, joined together with peel apart adhesive at a spine 54, although other arrangements of the tickets 12 are also contemplated. It is contemplated that several of the playing cards 10 show a bonus ticket symbol 42. In one embodiment, ten of the playing cards 10 can display a bonus symbol 42.

Each of the bonus tickets 12 in the set 50 is similar to playing card 10 in that a game symbol or symbols 60 is covered with a cover member 62 or members. The symbols 60 may be letters, numbers, and/or characters, such as fruit, diamonds, dollar signs, crowns, bells, and the like commonly associated with lottery games, which may be arranged singly, or in groups. The bonus tickets 12 are preferably marked with a serial number (not shown) which corresponds to the serial number marked on the master game card 14 and playing cards 10. Each of the bonus tickets in this embodiment preferably includes only a single cover member 62, or other game symbol concealing means. Preferably, the symbols are displayed on the inside surface 64 of an upper ply 66 of the card. The bonus ticket 12 is thus preferably a "break-open" playing card, in that the cover member 62 comprises a flap-like portion of a lower ply 68 which covers one or more game symbols 60. The flap 62 can be selectively opened (e.g. peeled away as shown in FIG. 7) from the ticket 12 in order to reveal a window 70 displaying the respective one or group of game symbols 60 beneath, after the set of cards have been distributed. The flap 62 has a perforated edge 72 allowing it to be readily separated from the surrounding upper ply material.

However, it will be understood that a game embodying the principles of the present invention may include playing cards, bonus tickets and a master game card otherwise configured, such as including "scratch-off" arrangements for initially concealing game symbols or groups of game symbols.

In a preferred embodiment, several of the symbols 60 on the bonus tickets are winning bonus ticket symbols 76. In the illustrated embodiment, the symbols 76 comprise the words "Ring of Fire" and "cash, tickets, or merchandise."Each winning bonus symbol 76 is associated with a specified instant win award 78. In the embodiment of FIG. 7, bonus tickets 12*a*, 12*b*, and 12*c* display winning awards 78 in the amounts of $25, $10, and $5, respectively. The holders of such winning bonus tickets 12 take their tickets to the game organizer to receive their bonus ticket awards 78.

In the embodiment of FIG. 7, the awards 78 may be in the form of cash, tickets, or merchandise, the holder of the bonus ticket 12 being given the opportunity to accept the award in any one of these three forms. Or, the game organizer may specify which one or two of the three forms the player may accept (for example, if no merchandise is available, the organizer may specify cash or tickets, or, if the game is the last one to be played at an event, the organizer may specify cash or merchandise). If the award is accepted in the form of tickets, these are preferably game playing cards 10 to be used in a subsequent lottery game of the same type. Or, the game organizer may award playing cards or bonus tickets for use in the same game or in another type of lottery game.

The remainder of the bonus tickets 12 display a "non-winning" symbol or symbols 79. For example, non-winning symbols may comprise numbers, as illustrated on the ticket 12*d* of FIG. 7. Alternatively, the non-winning tickets 12 may be left blank or otherwise marked as a non-winner. In another embodiment, the "non-winning" tickets 12 may display Bingo numbers, such as B02, N32, etc. These tickets 12 can then be used in a subsequent Bingo-type game.

In yet another embodiment, a single multi-flap bonus ticket (not illustrated) is awarded in place of a set 50. The single ticket may have a plurality of flaps similar to flaps 34, 62, each concealing a symbol or group of symbols similar to symbols 60.

In one embodiment, the sets 50 of bonus tickets 12 (or single multiple-flap ticket) are assembled such that each set contains a maximum of one bonus award 78. In a more preferred embodiment, however, some of the sets 50 in the deal contain more than one award, for example, 2, 3, 4, or 5 bonus symbols 76. Thus, for example, the holder of one set of bonus tickets may win $100 by having four bonus tickets with $25 awards. Another player may win $50 by having a $25 award, two $10 awards, and one $5 award. Thus the holder of the set of bonus tickets 12 would need to open every flap 62 to ensure that no awards are missed. The sets 50 may be assembled such that every set includes one (or more) award 78. Alternatively, the sets 50 of bonus tickets may be arranged such that some of the sets contain no award, while the remainder contain one or more awards.

In its additional, bonus level(s) of play, the present system permits selected ones of the players to become eligible for a bonus award through use of the master game card 14.

The bonus level of play of the present game system entails establishing selected game players who become eligible for the bonus award or awards, with these players then listed on the master game card 14 in the illustrated embodiment. To this end, the master game card 14 includes a sign up area 80, for listing the selected, eligible players (FIG. 9). The eligibility of these selected players is established by those players having cards having a predetermined selected one or more of the game symbols. In the illustrated embodiment, such predetermined eligible game symbols 82 comprise numeric designations ending in a red 13 (i.e., 113, 213, 313, etc.). FIG. 4 exemplifies a playing card 10*c* which reveals the eligible symbol 414 under one of the flaps 34*b*. Other characters could alternatively be used in place of the numerals preceding the number 13. Each of the eligible game symbols 82 is printed on one of the game playing cards.

Upon opening a flap 34 to reveal an eligible game symbol or group of eligible game symbols 82 (both will be referred to hereinafter simply as eligible game symbols), the game player preferably enters his name on the sign up area in the appropriate location (e.g., adjacent his eligible symbol 82). In the embodiment of FIG. 9, for example, eighteen eligible game symbols 82, all ending in the numerals "13", are contained within sign-up area 80 and are thus identified as being eligible game symbols 82.

Associated with each eligible game symbol 82 of sign-up area 80 is a name region 84. Each name region 84 provides space for the recordation of the name, or other indicia, identifying the holder of a playing card 10 which displays the associated eligible game symbol 82.

As shown in FIG. 9, the master game card 14 preferably comprises a lamination of upper and lower plies of material 86 and 88. The master game card 14 further includes an arrangement whereby a selected one (or more than one) of the listed, eligible players is identified as a winner in the bonus round (or in more than one bonus rounds) of play.

The master game card 14 is shown in FIGS. 9 and 10 as including a single bonus playing round, although it will be appreciated that more than one bonus round may be included. In the illustrated embodiment, the master game card 14 includes at least one award identifier 90, which is associated with the bonus round (FIG. 9). The award identifier 90 identifies an award 92 or awards ($599 in the illustrated embodiment). At least one winning game symbol 94 is associated with each award (FIG. 10). In the illustrated embodiment, the winning game symbol 94 is printed on an upper surface 98 of the lower ply 88 (FIG. 10). The winning game symbol 94 is covered by a cover member 100, such as a perforated flap similar to those on the playing cards 10, or other cover member, such as a scratch-off portion. The flap 100 is formed in the top ply 86 of the master game card and is pulled away to reveal the winning game symbol or symbols 94. The award 92, such as a monetary amount, is printed on a top surface of the flap 100, as shown in FIG. 9, or elsewhere on the master game card 14 or on playing cards 10. In the embodiment of FIGS. 9 and 10, for example, a single award of $599 is awarded to a single winner. The holder of the playing card 10 with the winning symbol 94 collects the award from the organizer.

If more than one winning game symbol 94 is used, there may be two or more winning symbols revealed, either by opening a single flap 100, or by opening more than one flap. Where more than one award is to be made, the awards may be of the same value or of different amounts. Where more than one flap 100 is provided, the flaps are preferably opened sequentially, in order of increasing value of the award or awards, to add to the excitement. For example, a first flap may be opened to reveal the winning game symbol(s) 94 corresponding to a $50 award, a second flap, the winner of a $150 award, and a third flap, the winner of a $399 award.

The holder of a winning playing card 10 (i.e., a card displaying a winning game symbol 94) receives the award 92 associated with the winning game symbol 94 present on that playing card, or which is associated with the particular winning game symbol 94, where more than two awards 92 are associated with the bonus round. For example, in the embodiment of FIG. 10, the playing card 10 showing the winning symbol 94 having the numeric designation "1413" is the bonus round winner. The holder of the playing card displaying winning game symbol "1413" thus receives a $599 award.

Initially, the flap (or flaps) 100 on the master game card is in a closed position, covering the associated winning game symbol 94 (or symbols), as shown in FIG. 9. The playing cards 10 are distributed and the players provided with time to open their flaps 34 and collect any instant win awards (i.e., the immediate win and bonus ticket awards). Then, the flap 100 on the master game card is opened in order to reveal the winning game symbol(s) 94 displayed beneath or information sufficient to identify the winning game symbol(s).

Although, in the illustrated embodiment, winning game symbol concealment is achieved through the use of a 2-ply master game card construction, the winning game symbol cover member 100 or members may have numerous alternative configurations. For example, master game card 14 may comprise only a single ply construction, with the winning game symbol cover member 100 comprising a flap-like member affixed to master game card 14 along one or more sides of the flap-like member. Alternatively, the winning game symbol cover member 100 may comprise a removable opaque substance, such as conventionally known "scratch-off" material.

In operation, the plurality of playing cards 10 are distributed to players of the present gaming system, who become holders of the playing cards 10 (it is of course contemplated that a player may give one or more of his playing cards to another person who then becomes the holder). If the present gaming system is being employed for fundraising purposes, each player will purchase one or more playing cards for a predetermined price, $1.00 in the illustrated embodiment. The holders of the playing cards remove or open the flaps 34 to reveal the game symbols 30 displayed upon the playing card 10. Holders of cards 10 displaying immediate instant-winning game symbols 40, such as three bars, three bells, or three fruits, as shown in FIG. 1, receive the corresponding designated awards. Holders of the cards 10 displaying bonus ticket symbols 42 receive one or more bonus tickets 12. The holders of the bonus tickets 12 then open their flaps 62 to determine if there are any winning bonus ticket symbols 76. Holders of bonus tickets 12 displaying winning bonus ticket symbols 76 receive the corresponding designated awards.

The names of the holders of playing cards displaying eligible game symbols 82, which, in the illustrated embodiment, are game symbols ending in the numeric designation "13", can be recorded within the sign-up area 80 at any time throughout this period. Once all the playing cards are sold and the holders of playing cards displaying eligible game symbols 82 have been identified, the winning game symbol cover member 100 is selectively removed or opened.

Figure 11:
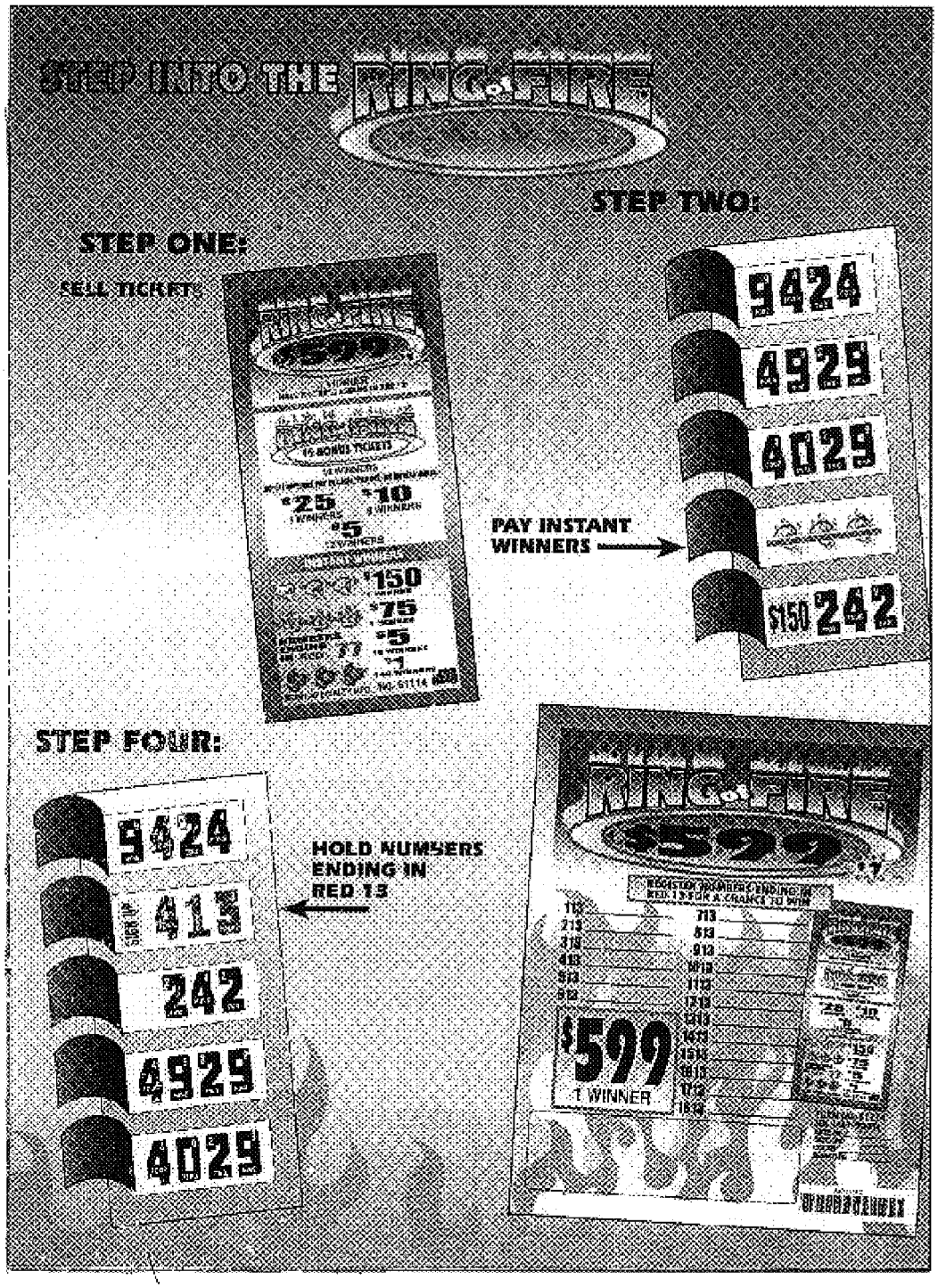
FIGS. 11 and 12 are top plan views showing two portions of a flier describing the game and providing exemplary definite payouts for various embodiments of the game.
Figure 12:
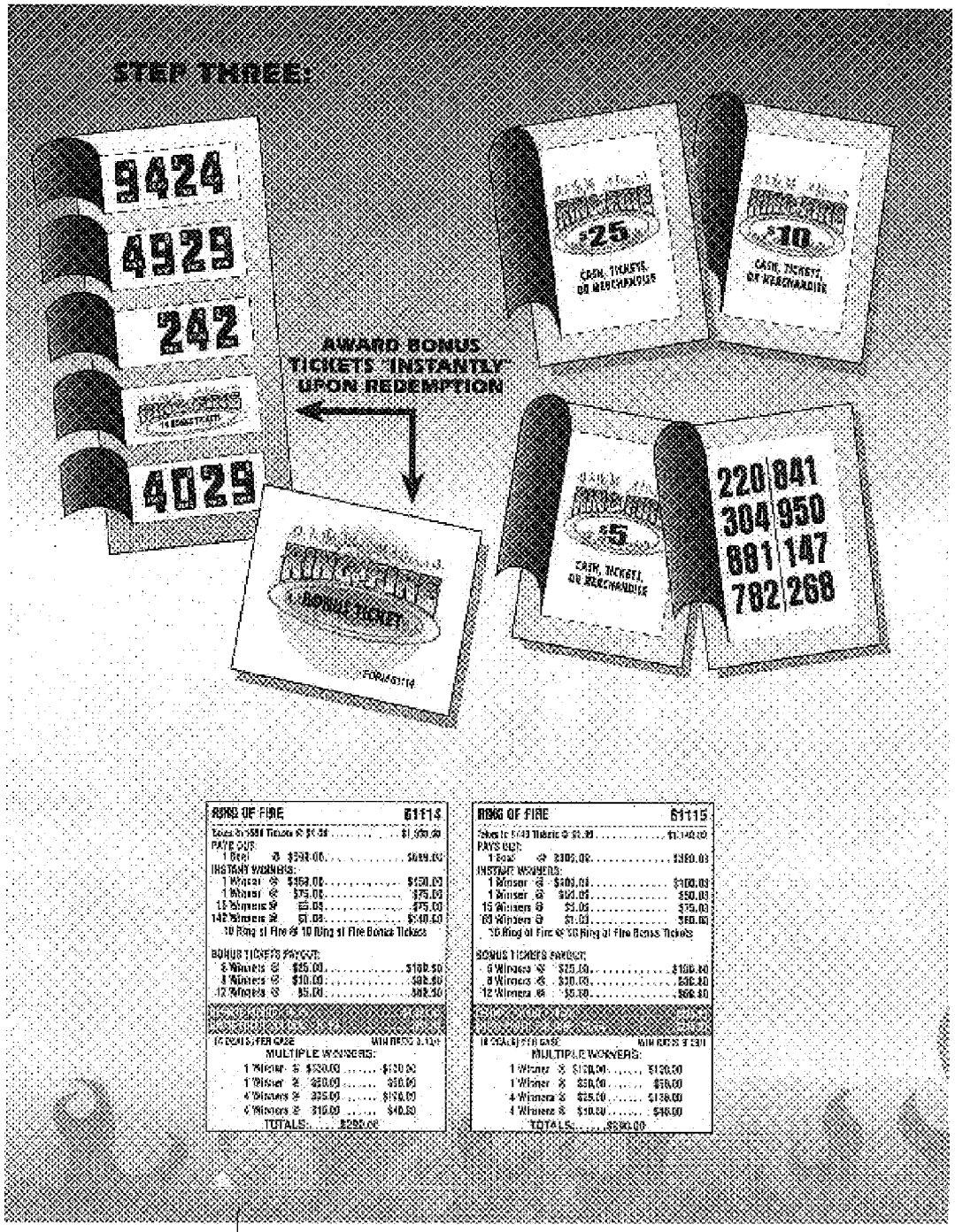

The assembled game system can include a set of playing cards 10, several sets of bonus tickets 12, and a master game card 14, as well as a printed set of instructions for play 110 (FIGS. 11 and 12). The instructions may include information about the payout, which can be a definite payout, when all of the cards are sold. The profit for the game organizer can also be displayed, based on the total income from the cards and the definite payout, optionally also taking into account the cost to the organizer of the set of cards.

As shown in FIG. 12, the award amounts and number of playing cards and bonus tickets in the deal can be tailored to meet the requirements of different game organizers. For example, one version of the game may have 1680 playing cards, for organizers of large games, another, 1140 playing cards, and so forth. The versions will all have different total payouts, as illustrated in FIG. 12, and may also have different percentage payouts, although it is preferable for the payout percentage to be the same or approximately the same so that players and the game organizer are familiar with the expected awards. The instructions may also contain information about the numbers of multiple winners and the payouts for the multiple winners.

In another embodiment, no playing card price is set on the playing card. The game proprietor can thus determine the payout ratio or design its own game.

As will be appreciated, variations of the present system can be made within the purview of the present invention. As noted, the playing cards 10 and bonus tickets 12 can be otherwise configured, as can the master game card 14. If desired, fewer or more than the disclosed levels of play can be provided. Additionally, plural arrangements can be provided for establishing the eligibility for bonus play of selected players. For example, two listings of eligible players can be provided on the master game card, with two different criteria identified for establishing eligibility. The playing card 10 is exemplary of the present invention in that the present game system includes a plurality of such playing cards such as, for example, in the illustrated embodiments, about 1140 cards or 1680 cards. Each of these playing cards 10 is separately purchased by a game player.

Although the invention has been described with reference to a master game card 14, other means for identifying a bonus round winner are also contemplated. For example, holders of playing cards displaying eligible game symbols 82 may participate in another game of chance to determine the winning eligible game symbol 94, such as by rolling a die or by use of Bingo-type balls. In yet another embodiment, there is no bonus round and all awards are made through the playing cards 10 or bonus tickets 12.

The invention has been described with reference to the preferred embodiments. Obviously, alterations and modifications will occur to others upon a reading and understanding of this specification. It is intended that the invention be construed as including all such modifications and alterations as fall within the scope of the appended claims or the equivalents thereof.

I claim:

1. A system for use in playing a game of chance comprising:

a plurality of playing cards, each of said playing cards including at least one game symbol displayed thereon, at least some of said plurality of playing cards displaying a bonus ticket symbol which entitles a holder of the playing card to receive at least one bonus ticket; and a plurality of said bonus tickets, each of said bonus tickets displaying a game symbol, at least one of the bonus tickets including one of said game symbols which is a winning bonus ticket symbol associated with a bonus ticket award.

2. The system of claim 1, further comprising:

a master game card for use in conjunction with said plurality of playing cards, wherein at least some of said plurality of playing cards include eligible game symbols which are eligible for a bonus round award, said master game card including at least one winning game symbol selected from said eligible game symbols associated with said bonus round award.

3. The system of claim 1, wherein said bonus tickets are packaged in sets, said bonus ticket symbol entitling the holder of the playing card to receive a set of bonus tickets.

4. The system of claim 3, wherein at least one of each of said set of tickets includes a winning bonus ticket symbol.

5. The system of claim 3, wherein the bonus tickets in a set are bound together.

6. The system of claim 1, wherein the bonus ticket award includes a monetary value which the holder is entitled to receive in at least one of cash, tickets, and, merchandise.

7. The system of claim 1, wherein a total of said bonus ticket awards is a fixed amount for the plurality of playing cards.

8. The system of claim 2, wherein said master game card further includes:

an award identifier for identifying said bonus round award; and a cover member for initially concealing said winning game symbol selected from said eligible game symbols associated with said identified bonus round award.

9. The system of claim 1, wherein said at least one bonus ticket includes a cover member for initially concealing said game symbol.

10. The system of claim 1, wherein at least one of said game symbols of at least one of said playing cards comprises indicia identifying said game symbol as being an immediate instant winning game symbol entitling the holder to receive an award.

11. The system of claim 2, wherein said master game card includes a signup area for identifying holders of playing cards which include at least one eligible game symbol.

12. A system for use in playing a game of chance comprising:

a plurality of playing cards, each of said playing cards including at least one of a plurality of game symbols displayed thereon, at least some of said plurality of playing cards displaying a bonus ticket game symbol of said plurality of game symbols, each of said bonus ticket game symbols entitling a holder of the ticket to receive a plurality of bonus tickets, at least some of said plurality of playing cards displaying an eligible game symbol of said plurality of game symbols which is eligible for a bonus round award;

a plurality of bonus tickets, at least one of said bonus tickets including an indicia for identifying the bonus ticket as a winning bonus ticket; and a master game card for use in conjunction with said plurality of playing cards, said master game card including means for identifying one of said eligible game symbols as a winning game symbol.

13. The system of claim 12, wherein said playing cards displaying a bonus ticket symbol do not display an eligible game symbol.

14. The system of claim 12, wherein said means for identifying one of the eligible game symbols as a winning game symbol includes a cover member for initially concealing the winning game symbol.

15. A package containing the playing cards, bonus tickets, and master game card of claim 12.

16. A method of playing a game of chance comprising:

distributing a set of playing cards to a plurality of players;

removing at least one cover member on each of the playing cards to reveal at least one of a plurality of game symbols, at least some of said plurality of playing cards including an eligible game symbol of said plurality of game symbols which is eligible for a bonus round of play, at least some of said plurality of playing cards including a bonus ticket game symbol of said plurality of game symbols which entitles a holder of the playing card to receive at least one bonus ticket from a plurality of bonus tickets;

removing at least one cover member from said bonus tickets, at least one of said bonus tickets including an identifier for identifying an instant win award; and in the bonus round of play, uncovering a winning game symbol selected from said eligible game symbols associated with a bonus award, a holder of the playing card displaying the winning game symbol receiving the bonus award.

17. The method of claim 16, wherein said playing cards displaying a bonus ticket symbol do not display an eligible game symbol.

18. A method of playing a game of chance comprising:

distributing a set of playing cards to a plurality of players, said playing cards being configured for selectively revealing a plurality of game symbols, at least a first of said game symbols being employed in a first level of play and at least a second of said game symbols being employed in a second level of play;

revealing at least some of said plurality of game symbols;

in a first level of play, awarding at least one bonus ticket of a plurality of bonus tickets to at least one of said plurality of players holding one of said playing cards which displays said at least said first game symbol, at least some of said plurality of bonus tickets including an identifier for identifying an instant win award;

in a second level of play, awarding a bonus award to at least one of said players holding a card which displays at least said second game symbol.

19. The method of claim 18, wherein at least some of the bonus tickets display Bingo numbers and the method further comprises:

playing a Bingo game, wherein at least one of the holders of bonus tickets displaying Bingo numbers wins an award.

* * * * *